US011801697B2

(12) United States Patent
Tsuchiya

(10) Patent No.: US 11,801,697 B2
(45) Date of Patent: Oct. 31, 2023

(54) PRINTER WITH HOLDING AND PRESSING MEMBERS THAT ARE ENGAGEABLE WITH EACH OTHER TO HOLD A COVER CLOSED

(71) Applicant: TOSHIBA TEC KABUSHIKI KAISHA, Tokyo (JP)

(72) Inventor: Motohito Tsuchiya, Mishima Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 606 days.

(21) Appl. No.: 16/875,077

(22) Filed: May 15, 2020

(65) Prior Publication Data

US 2021/0053375 A1 Feb. 25, 2021

(30) Foreign Application Priority Data

Aug. 20, 2019 (JP) ..... 2019-150550

(51) Int. Cl.

| | |
|---|---|
| ***B41J 29/13*** | (2006.01) |
| ***B41J 15/04*** | (2006.01) |
| ***B41J 2/32*** | (2006.01) |
| ***B65C 9/18*** | (2006.01) |
| ***B41J 3/407*** | (2006.01) |
| *B65C 11/02* | (2006.01) |
| *B65C 9/00* | (2006.01) |

(52) U.S. Cl.

CPC ..... *B41J 29/13* (2013.01); *B41J 2/32* (2013.01); *B41J 3/4075* (2013.01); *B41J 15/04* (2013.01); *B41J 15/042* (2013.01); *B65C 9/18* (2013.01); *B41J 2202/31* (2013.01); *B65C 11/02* (2013.01); *B65C 2009/0093* (2013.01); *B65C 2210/0089* (2013.01)

(58) Field of Classification Search

CPC ..... B41J 3/4075; B41J 15/04; B41J 15/042; B41J 29/13; B65C 9/18; B65C 2009/0093; B65C 2210/0089

See application file for complete search history.

(56) References Cited

U.S. PATENT DOCUMENTS 7,125,181 B2 * 10/2006 Takabatake ..... B41J 15/042 400/605
7,828,490 B2 * 11/2010 Nihashi ..... B41J 2/32 347/171

(Continued)

FOREIGN PATENT DOCUMENTS

JP 2015-174221 A 10/2015

*Primary Examiner* — Jill E Culler
(74) *Attorney, Agent, or Firm* — Kim & Stewart LLP

(57) ABSTRACT

A printer includes a body including a label sheet storage location and a cover rotatably attached to the body and covering the storage location when closed. The cover includes a roller having a shaft that is used for conveying the label sheet when the cover is closed and a peeling bar extending above the roller. The body includes a pressing member extending along the direction and pressing the sheet against the bar for peeling a label from the label sheet and a release lever arranged at an end of the pressing member. The release lever has a recess and rotates between a first position at which the shaft fits into the recess and a second position at which the shaft is released. The release lever rotates from the first to second positions to open the cover when a release button is pressed.

18 Claims, 15 Drawing Sheets

(56) References Cited

U.S. PATENT DOCUMENTS

| | | | | |
|---|---|---|---|---|
| 9,643,435 | B2 * | 5/2017 | Hirose | B41J 11/04 |
| 2001/0016135 | A1 * | 8/2001 | Hosomi | B41J 15/042 400/613 |
| 2006/0165467 | A1 * | 7/2006 | Kawakami | B41J 3/4075 400/613 |
| 2017/0274685 | A1 * | 9/2017 | Hirose | B65C 9/18 |

* cited by examiner

PRINTER WITH HOLDING AND PRESSING MEMBERS THAT ARE ENGAGEABLE WITH EACH OTHER TO HOLD A COVER CLOSED

CROSS-REFERENCE TO RELATED APPLICATIONS

This application is based upon and claims the benefit of priority from Japanese Patent Application No. 2019-150550, filed on Aug. 20, 2019, the entire contents of which are incorporated herein by reference.

FIELD

Embodiments described herein relate generally to a printer.

BACKGROUND

Various portable printers have been developed that comprise a sheet storage portion that stores paper sheets within the housing. The housing includes a main body having an open portion and a cover for covering the open portion, and the cover can be opened when the paper sheets are to be refilled or replaced.

Some portable printers have a function of printing an image on a label which is attached to a backing substrate and then issuing the label in a state in which the label has been peeled from the backing substrate (also referred to as a mount or mounting substrate). In order to discharge a label in a peeled state, those type printers typically comprise a peel bar and a pressing member. The pressing member presses the printed label against the peel bar so that the center of the backing substrate is bent towards the label side. As a result, the label can be peeled from the backing substrate.

There is a conventional printer in which the cover can be opened and the pressing member retracted in response to a single operation/action by the user for convenience of the user. However, the required mechanism for interlocking pressing member and cover tends to be complicated, which results in increase of the number of mechanical parts used in the printer. Accordingly, there is a need for a printer that achieves the aforementioned functions with a simple mechanism.

DETAILED DESCRIPTION

One or more embodiments provide a printer capable of retracting a pressing member when the cover is opened in response to a user's single operation with a simple mechanism.

In an embodiment, a printer includes a body including a sheet storage location for storing a label sheet, a cover that is rotatably attached to the body and covers the sheet storage unit when closed, and a release button for opening the cover when closed. The cover includes a roller having a shaft and configured to convey the label sheet when the cover is closed and a peeling bar extending above the roller along a longitudinal direction thereof. The body further includes a pressing member that extends along the longitudinal direction. When the cover is closed, the pressing member presses a part of the label sheet conveyed by the roller against the peeling bar so as to peel a label from the label sheet. A release lever is at an end of the pressing member in the longitudinal direction. The release lever has a recess and rotates between a first position at which the shaft of the roller fits into the recess and is thereby held and a second position at which the shaft is released from the recess. The release lever rotates from the first position to the second position to open the cover in response to pressing of the release button.

Figure 1:
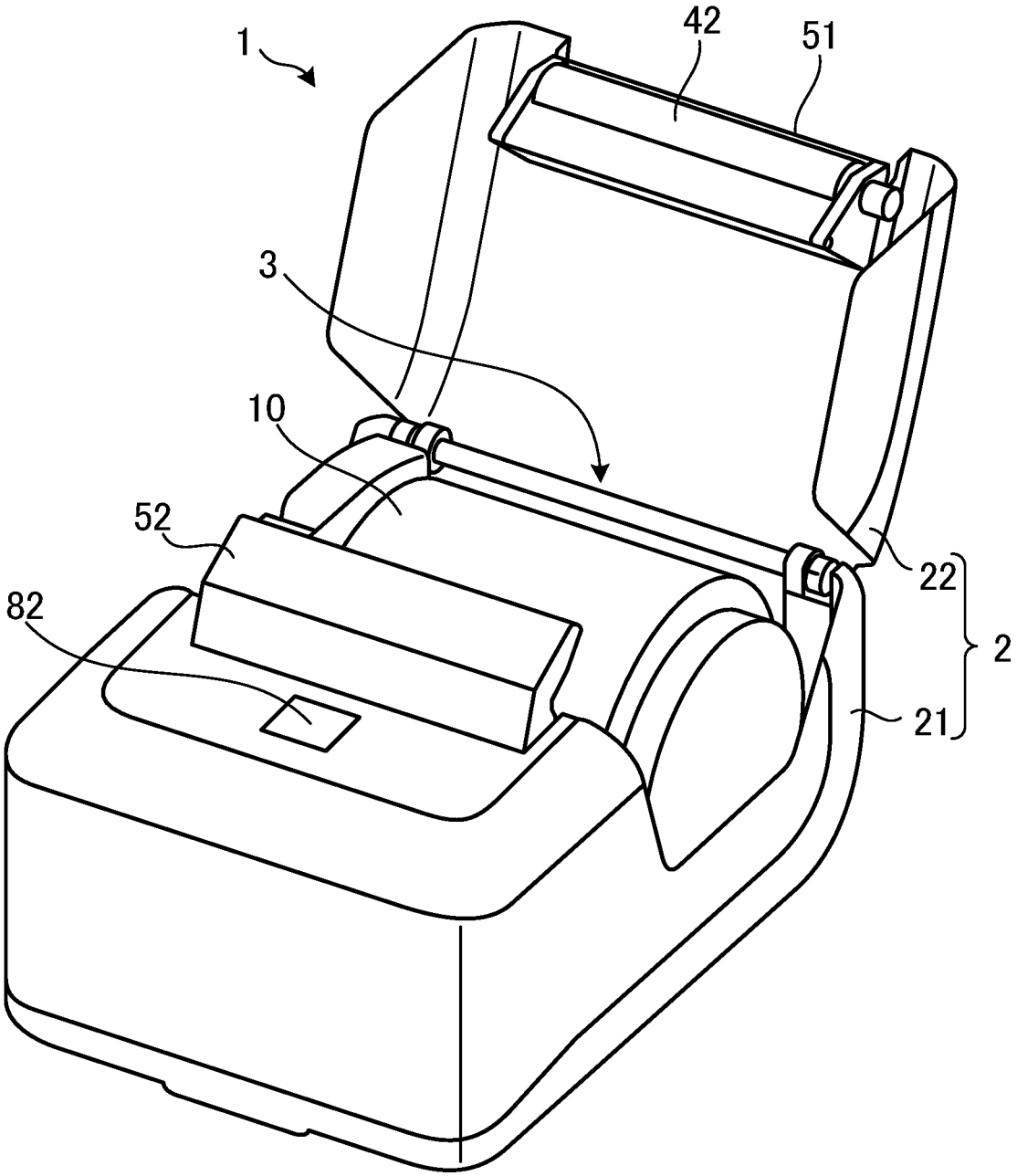
FIG. 1 is a perspective view of a printer according to an embodiment in a state in which a cover has been opened.
Figure 2:
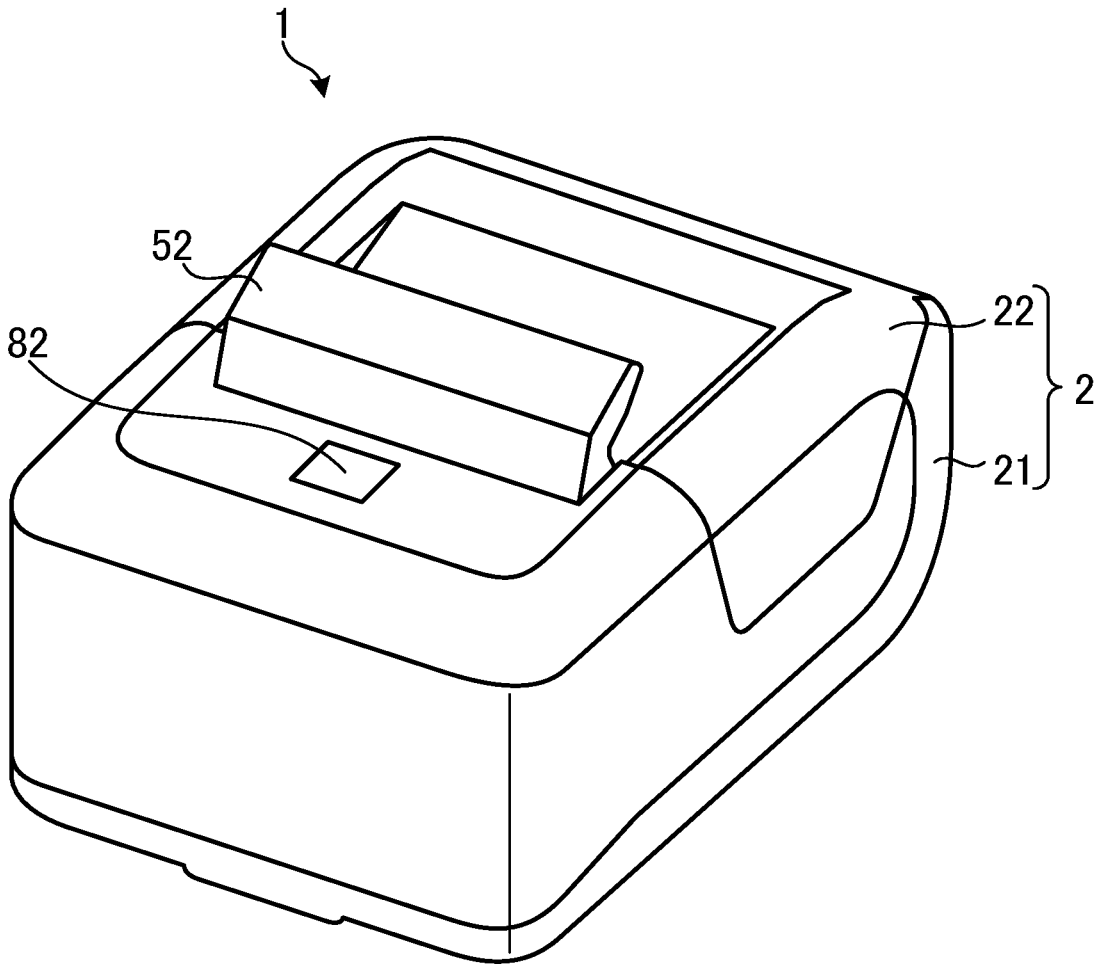
FIG. 2 is a perspective view of a printer according to an embodiment in a state in which a cover has been closed.
Figure 3:
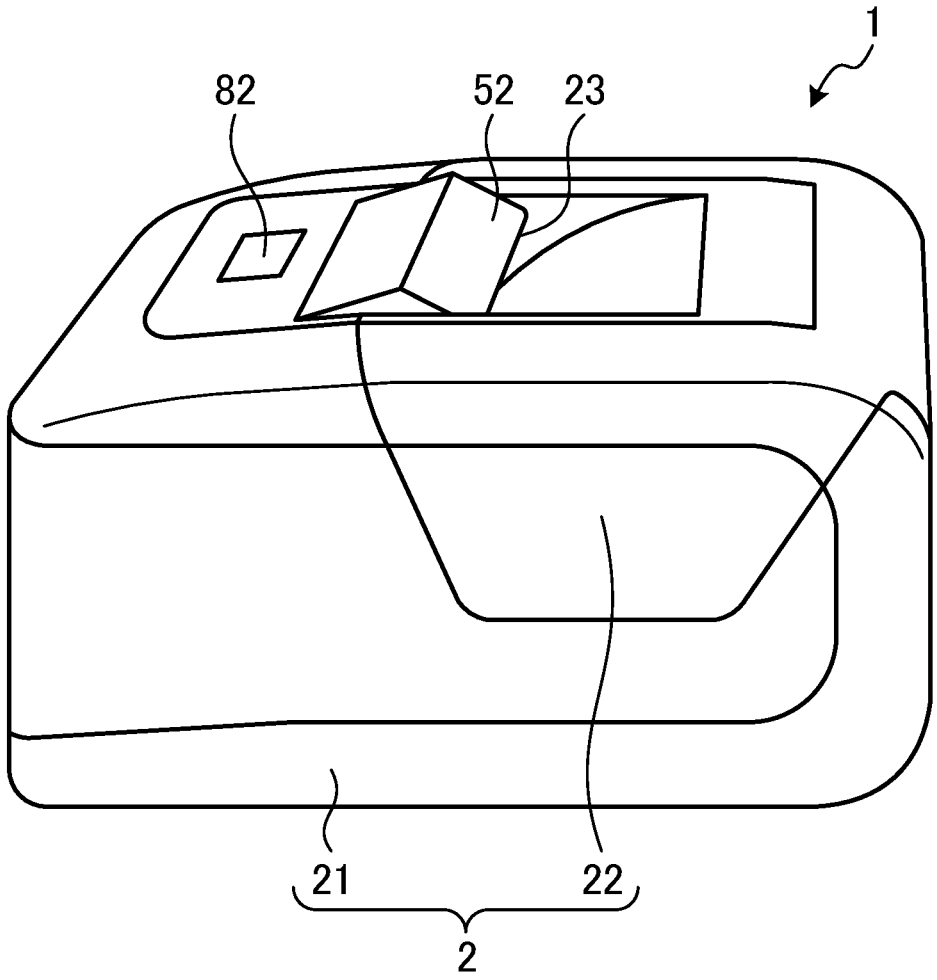
FIG. 3 is a perspective view of a printer in an operable state.

Embodiments will be described with reference to the drawings. FIG. 1 is a perspective view of a printer 1 in which a cover 22 is opened. FIG. 2 is a perspective view of the printer 1 in which the cover 22 is closed. FIG. 3 is a perspective view of the printer 1 in an operable state.

Figure 4:
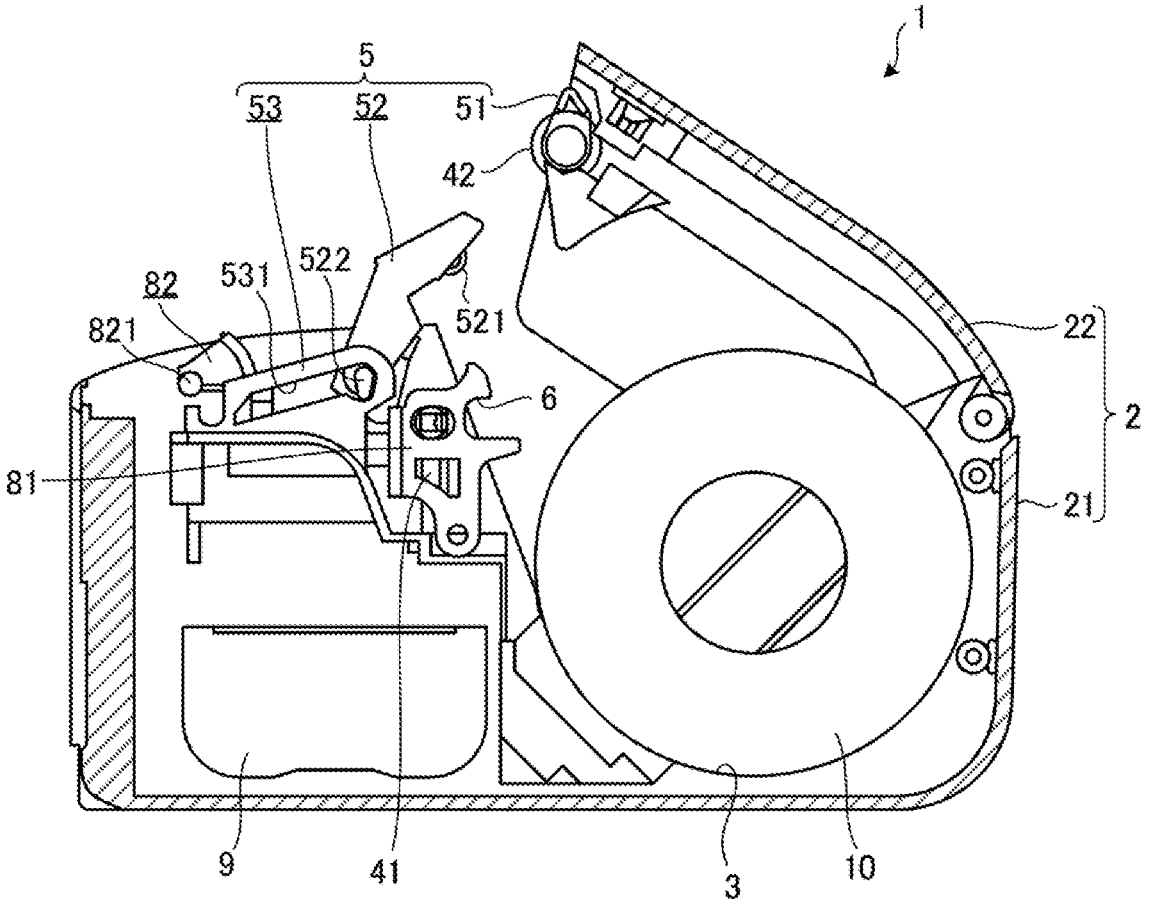
FIG. 4 is a cross-sectional side view of a printer with the cover opened.
Figure 5:
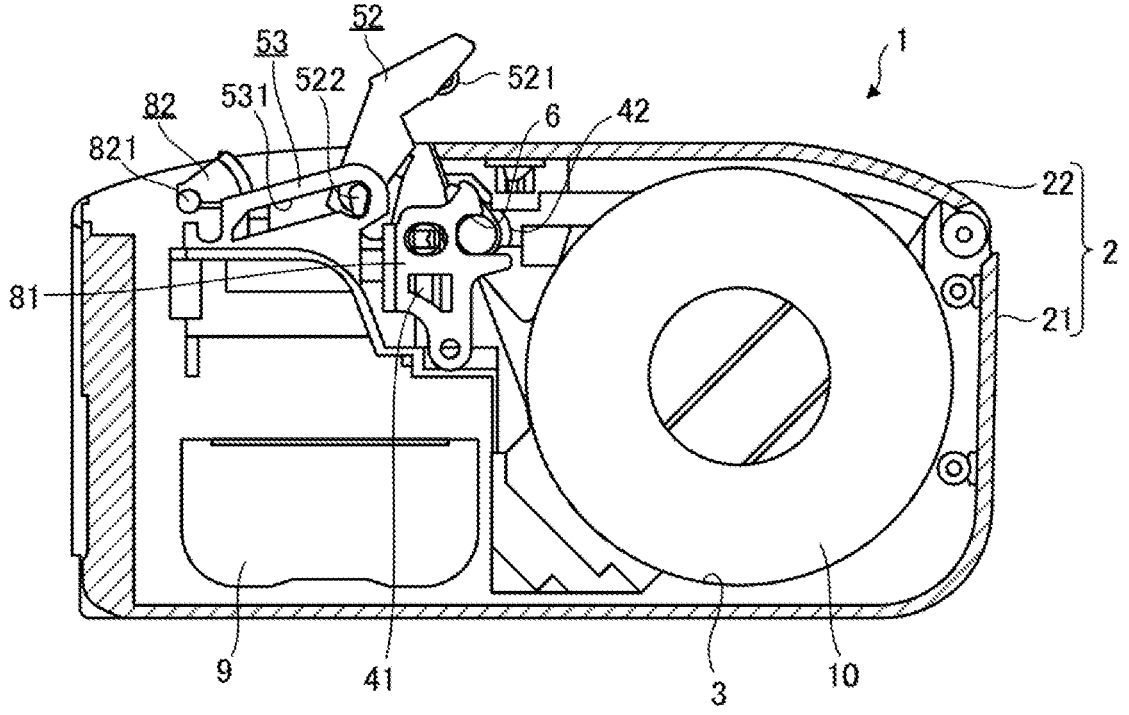
FIG. 5 is a cross-sectional side view of a printer with the cover closed.
Figure 6:
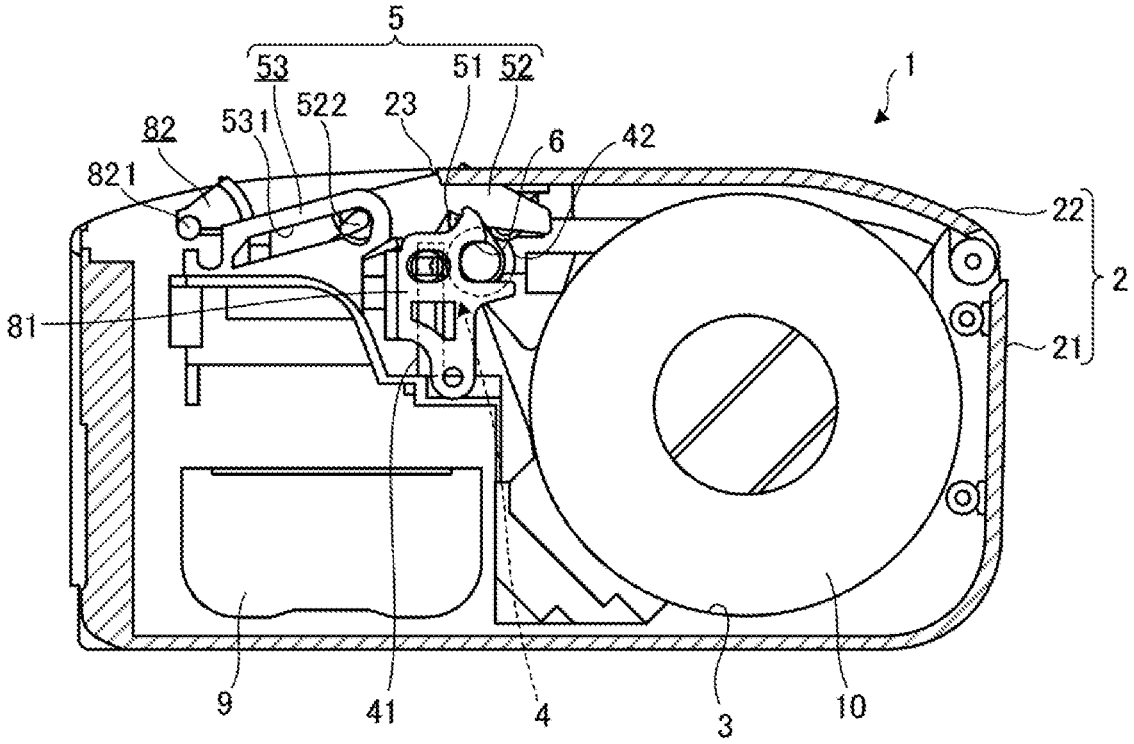
FIG. 6 is a cross-sectional side view of a printer in an operable state.

FIG. 4 is a cross-sectional side view of the printer 1 in which the cover 22 is open as shown in FIG. 1. FIG. 5 is a cross-sectional side view of the printer 1 in which the cover 22 is closed as shown in FIG. 2. FIG. 6 is a cross-sectional side view of the printer 1 in an operable state shown in FIG. 3.

For example, as shown in FIG. 6, the printer 1 includes housing 2, sheet storage portion 3, printing unit 4, and peel portion 5 for printing on paper roll 10. The paper roll 10 includes labels each having an adhesive layer on a back surface. The housing 2 includes a main body 21 and the cover 22 and houses the sheet storage portion 3, the printing unit 4, the peel portion 5, and a battery 9. The battery 9 is a rechargeable battery that supplies electric power for the printer 1 to operate.

For example, as shown in FIG. 1, the main body 21 is a box like container having an opening, and includes the sheet storage portion 3 and the printing unit 4. The cover 22 is rotatably supported at one end portion of the main body 21 (hereinafter called the rotation side end portion), and moves between an open position (see FIGS. 1 and 4) where the open portion of the main body 21 is not covered and a closed position (see FIGS. 3 and 6) where the open portion is covered. By such movement of the cover 22, a user can access the sheet storage portion 3 when necessary. The cover 22 is biased (urged) in a direction away from the main body 21 from the closed position toward the open position by an urging member such as a spring.

As shown in FIG. 3, when the cover 22 is in the closed position, a gap (serving as a discharge port 23) is left between the moving side end portion of the cover 22 and the main body 21. The discharge port 23 is an opening permitting the discharging of the sheets after printing.

The sheet storage portion 3 is provided in the main body 21 and is covered or uncovered by the cover 22. Further, in this example, the sheet storage portion 3 holds the paper roll 10 so that the paper sheet can be drawn out from the roll.

Referring back to FIG. 6, the printing unit 4 is disposed in the main body 21 so as to contact the rotation side end portion of the cover 22 when the cover 22 is closed, and prints an image on the sheet pulled out from the sheet storage portion 3. The printing unit 4 includes a print head 41 and a platen 42.

The print head 41 is provided in the main body 21. The platen 42 is attached to the cover 22 by a holding member 24 (see FIG. 12). With the cover 22 in the closed position, the platen 42 comes in contact with the print head 41, and the printing unit 4 becomes ready for printing.

The print head 41 is, for example, a thermal head, and prints on a printing surface of a label by heating a thermosensitive coloring layer provided on the printing surface of the label to produce color. The platen 42 is a roller that sandwiches the paper including the label with the print head 41 and draws out the paper from the sheet storage portion 3 and conveys the paper.

The peel portion 5 is disposed in the vicinity of the discharge port 23 to peel the label from the mount (backing substrate). The peel portion 5 comprises a peel bar 51, a pressing member 52 and a supporting member 53. The peel bar 51 is provided along the axial direction of the platen 42 on the downstream side in the sheet conveying direction of the printing unit 4. The peel bar 51 is, for example, a rectangular plate bent along the axial direction of the platen 42 so as to have a ridged or peaked shape. The peel bar 51 is arranged so that the ridge line faces the discharge port 23 and is parallel to the axial direction of the platen 42, and is provided at the moving side end portion of the cover 22.

The pressing member 52 is movable between a peeling position (see FIG. 6) and a retracted position (see FIG. 5) by being supported by a supporting member 53 and has a flap-like shape. The pressing member 52 is biased in the direction from the peeling position toward the retracted position (that is, a direction away from the main body 21) by a biasing member such as a spring. The pressing member 52 is guided by the supporting member 53 and is further movable between the peeling position and a continuous position (refer to FIG. 8). Here, the continuous position is the position of pressing member 52 when the label is discharged without being peeled from the mount.

The pressing member 52 at the peeling position shown in FIG. 6 presses the paper being conveyed against the peel bar 51 to bend the paper along the outer peripheral surface of the peel bar 51 so that the label is peeled from the paper. The pressing member 52 includes a peel roller 521 at its distal end. The peel roller 521 sandwiches the paper between the pressing member 52 and the platen 42 when the pressing member 52 is at the peeling position.

The supporting member 53 supports and guides the pressing member 52 to move between the peeling position and the retracted position and between the peeling position and the continuous position. Specifically, the supporting member 53 has a groove 531 on each side in the longitudinal direction of the supporting member 53 so that a projection portion 522 provided on each side of the pressing member 52 fits into and moves along the groove 531.

The cross-sectional shape of the projection portion 522 is not circular but is close to an ellipse, and the thickness thereof is different depending on the orientation. An end portion of the groove 531 where the projection portion 522 of the pressing member 52 is positioned at the peeling position is formed to be wider so that the projection portion 522 can rotate, and the other portion is formed narrower so as to guide the projection portion 522 along the groove 531 while maintaining the orientation of the projection portion 522.

The pressing member 52 at the peeling position projects from the main body 21 to press the paper against the peel bar 51. In addition, the pressing member 52 at the retracted position is retracted to the outside of the main body 21 and separated from the cover 22 so as not to interfere with the rotation of the cover 22. That is, when the pressing member 52 is at the retracted position, the cover 22 is movable to an open position (see FIG. 4). Then, at the pressing member 52 at the continuous position (see FIG. 8), at least the root portion thereof is housed in the main body 21, and the tip portion of the pressing member does not project into the discharge port 23 region so that the pressing member 52 does not interfere with the peel bar 51.

Figure 7:
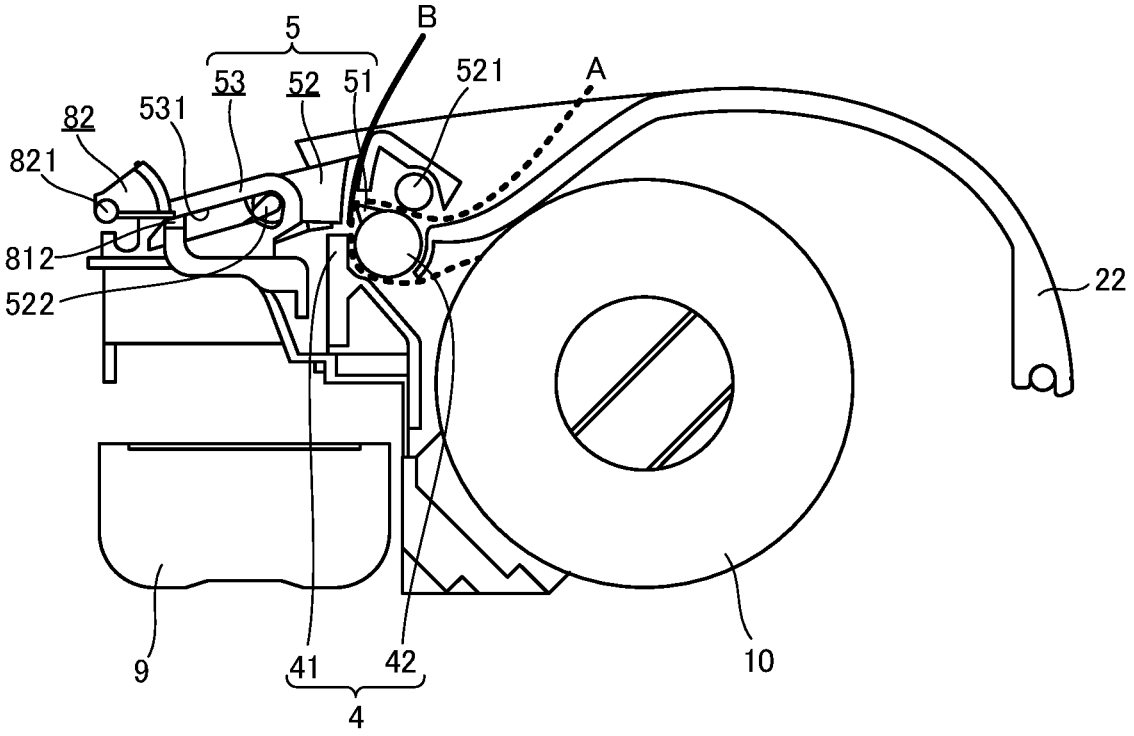
FIG. 7 is a cross-sectional side view depicting aspects of a sheet conveying path of a printer.

FIG. 7 is a cross-sectional side view of the printer 1 showing the paper conveyance path. In the printer 1 having the structure as described above, the paper roll 10 stored in the sheet storage portion 3 is drawn for printing by the printing unit 4 and a portion of the paper roll 10 on which an image can be formed is discharged from the discharge port 23. When the pressing member 52 is at the peeling position, the backing substrate is transported along the path of the dashed line A and the label is peeled from the backing substrate and travels along the path of the solid line B.

Figure 8:
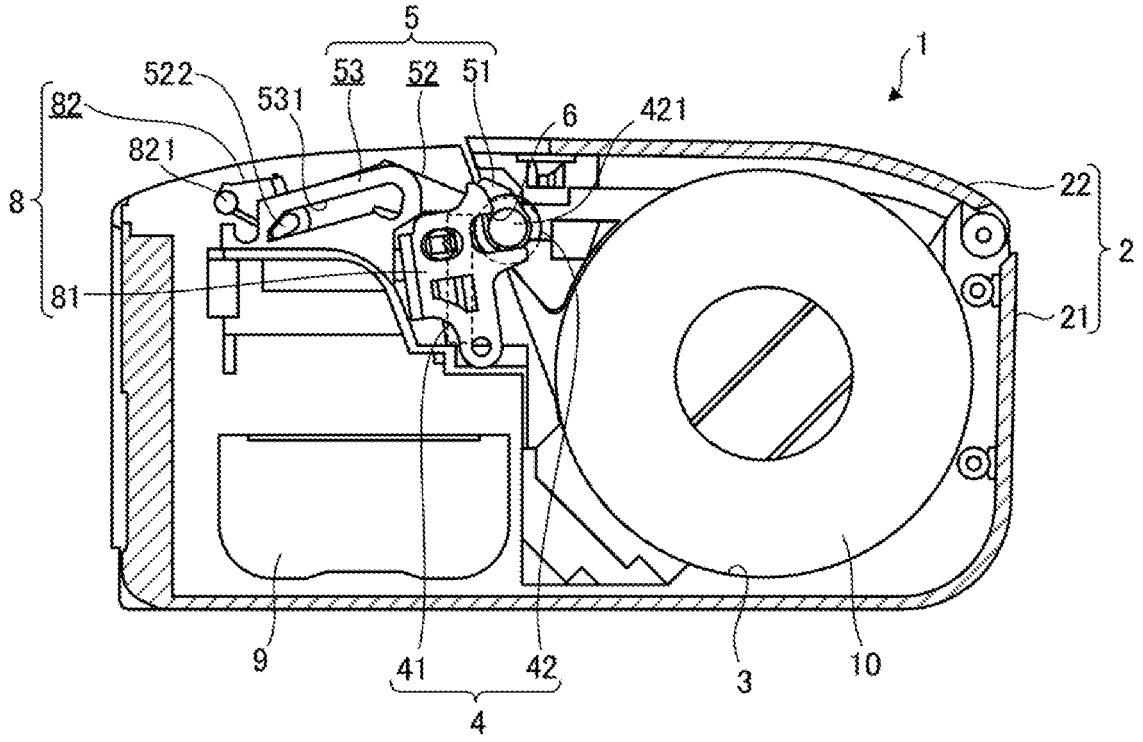
FIG. 8 is a cross-sectional side view of a printer when a lock release operation has been performed.

FIG. 8 is a cross-sectional side view of the printer 1 when a lock release operation is performed. The printer 1 further includes a pair of first lock portions 6, a pair of second lock portions 7 (see FIG. 12), and an unlock mechanism 8. The first lock portion 6 and the second lock portion 7 are disposed near both ends in the longitudinal direction of the platen 42 inside the housing 2.

The first lock portion 6 holds the both ends of the platen 42 at a closed position at which the sheet storage portion 3 is covered by the cover 22 against the urging force, and is movable between the position where the cover 22 is held and the position where the cover 22 is not held.

The second lock portion 7 secures the pressing member 52 at the peeling position relative to the cover 22 (see also FIG. 12 explained later). The unlock mechanism 8 rotates the first lock portion 6 in response to the user's operation. The unlock mechanism 8 comprises a pair of release levers 81 and a release button 82.

The release button 82 is a button which is rotatable about a pivot shaft 821. The release button 82 is partially exposed to the outside of the housing 2 as shown in FIG. 1 to FIG. 6, and in response to a pressing operation from the user, transmits the pressing operation to the pair of release levers 81. The release button 82 is biased in the counterclockwise direction in FIG. 8 by an urging member such as a spring, and when the user does not depress the release button 82, it returns to the original position shown in FIG. 8.

Figure 9:
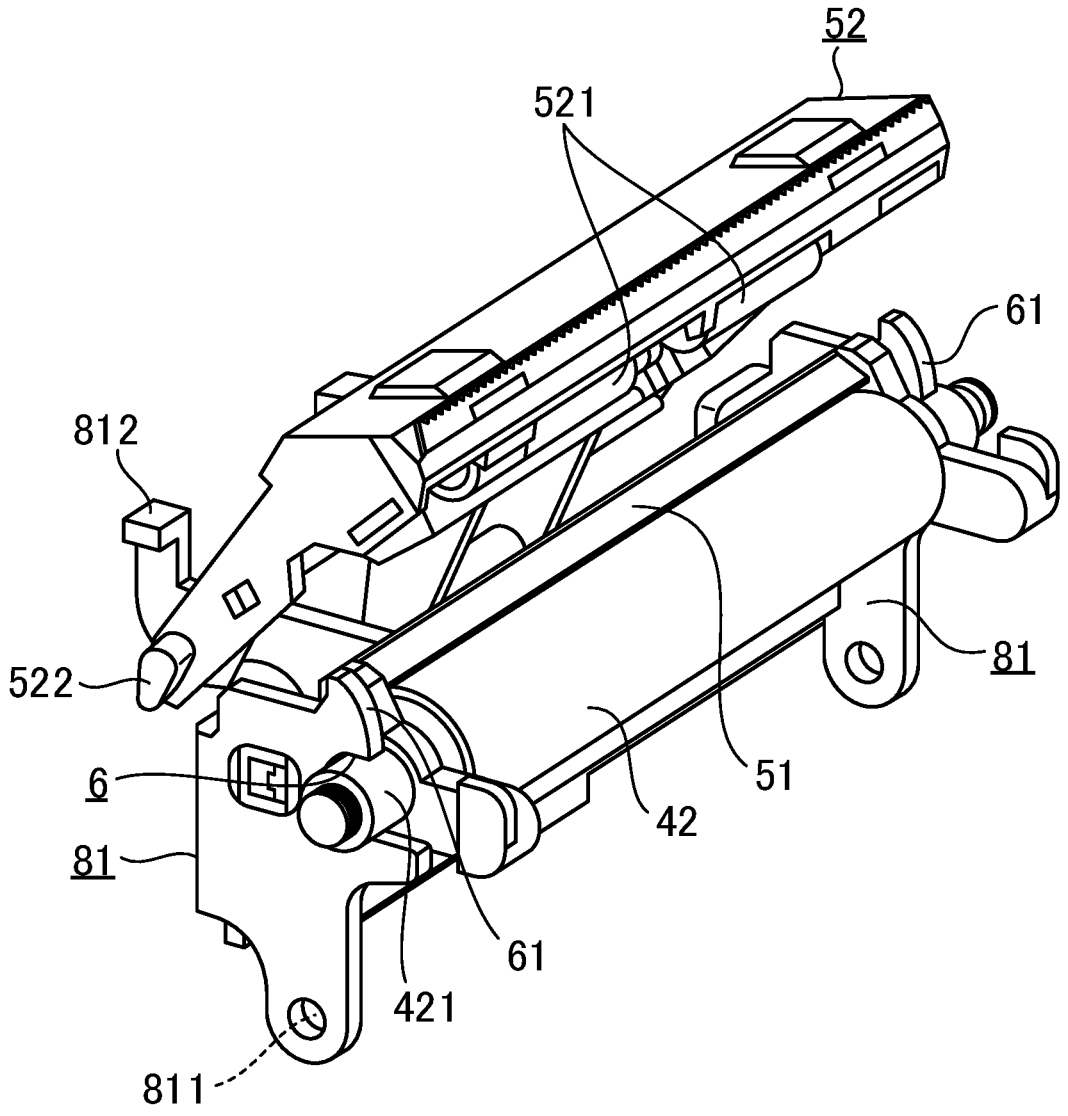
FIG. 9 is a perspective view showing the positional relationship of a platen, a peel bar, a pressing member, a first lock portion, and a release lever.
Figure 10:
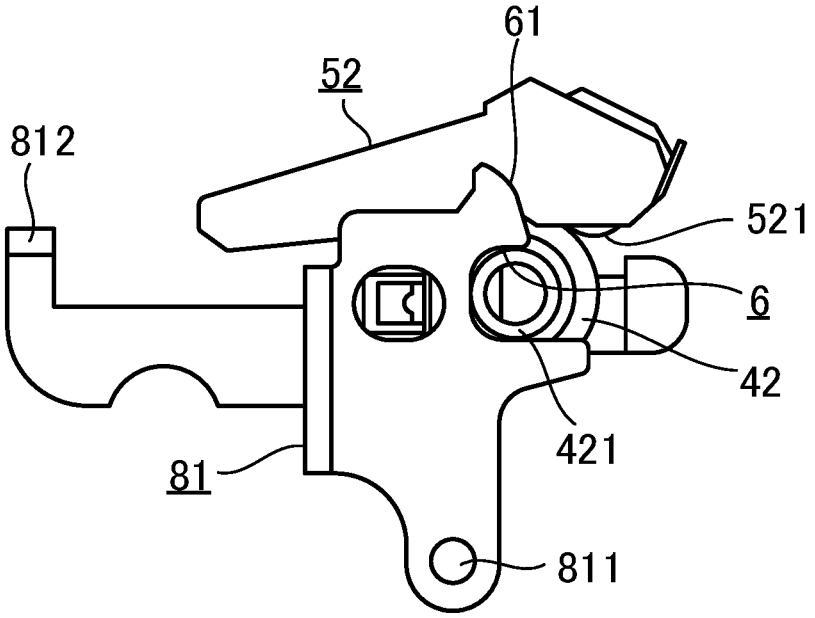
FIG. 10 is a side view showing the positional relationship between a first lock portion and a release lever.

FIG. 9 is a perspective view showing the positional relationship of the platen 42, the peel bar 51, the pressing member 52, the first lock portion 6 and the release lever 81. FIG. 10 is a side view showing the positional relationship between the first lock portion 6 and the release lever 81. The release lever 81 is rotatable about a pivot hole 811, and is biased in a clockwise direction in FIG. 8 by an urging member such as a spring. The release lever 81 also includes an actuating portion 812 disposed at a location where a pressing action applied to release button 82 is conveyed.

The first lock portion 6 is integrated with the release lever 81. The first lock portion 6 in an embodiment has a recess for holding the end portion of the shaft 421 of the platen 42 from the release lever 81. When the shaft 421 is fitted in this recess, the platen 42 is held on the main body 21, whereby the cover 22 to which the platen 42 is attached is positioned on the main body 21, and the cover 22 is held at the closed position.

Figure 11:
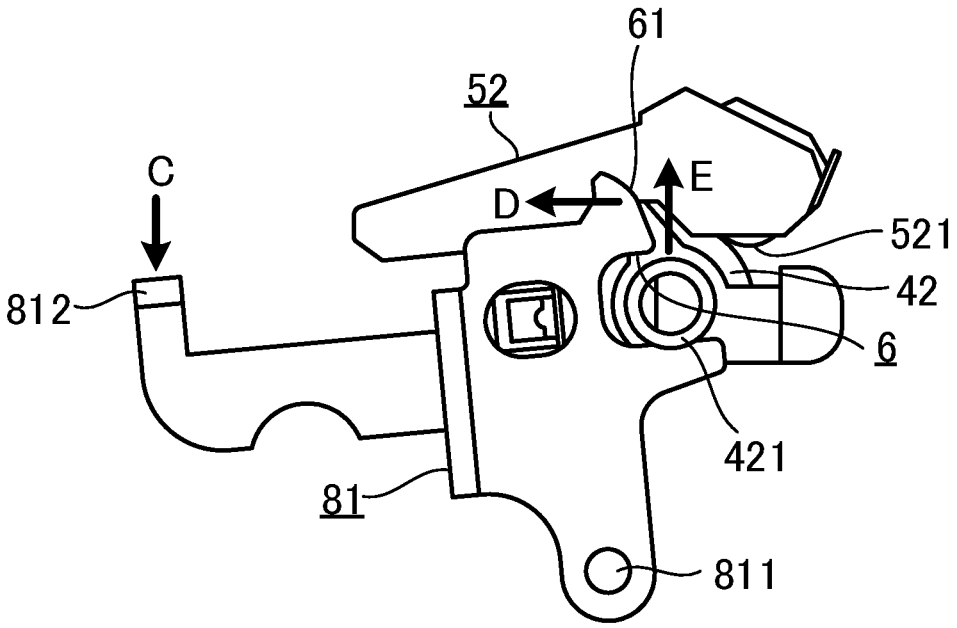
FIG. 11 is a side view showing an operation for releasing a first lock portion by a release lever.

FIG. 11 is a side view showing the release operation of the first lock portion 6 by the release lever 81. When the user presses the release button 82, the movement is transmitted to the actuating portion 812 in the direction indicated by arrow C, and the release lever 81 rotates in the counterclockwise direction (arrow D) about the pivot hole 811. Since the first lock portion 6 is integrated with the release lever 81, the shaft 421 is released in accordance with the rotation of the release lever 81. The shaft 421, which has been released from the first lock portion 6, moves in the direction (arrow E) by which the cover 22 is opened by the biasing force applied by the biasing member.

Here, a guide portion 61 is provided in the release lever 81 at a position closer to the cover 22 than the first lock portion 6. The guide portion 61 in an embodiment forms an inclined surface of the outer peripheral surface of the release lever 81 to guide the released shaft 421 of the platen 42 to the first lock portion 6.

When the cover 22 is closed, the outer peripheral surface of the shaft 421, which moves with the cover 22, slides along the guide portion 61, and causes the release lever 81 to pivot counterclockwise against the urging force. The guide portion 61 directs the shaft 421 toward the first lock portion 6. When the shaft 421 is fitted into the first lock portion 6, the release lever 81 rotates in the clockwise direction in accordance with the urging force to return to the position shown in FIG. 10.

Figure 12:
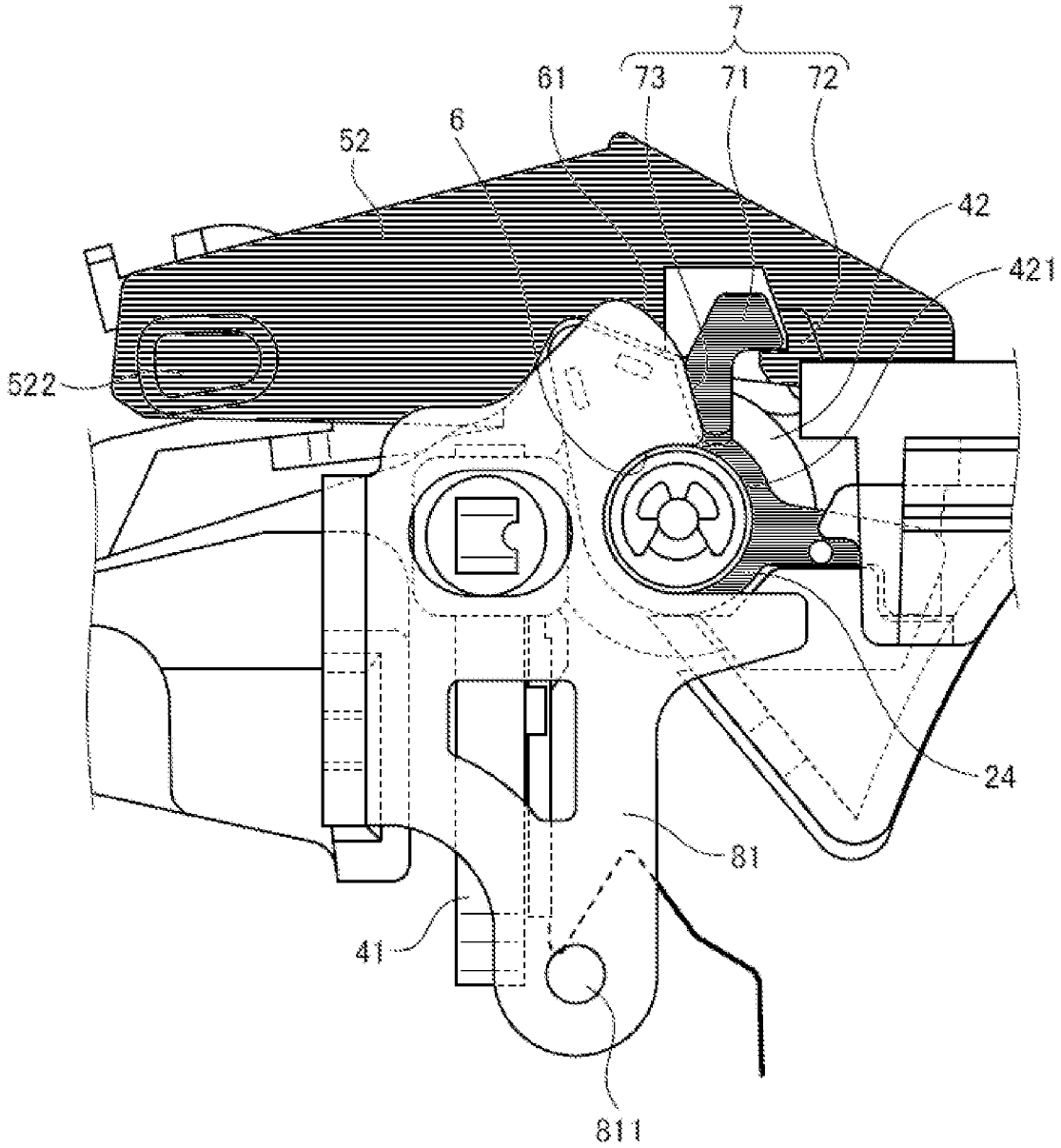
FIG. 12 is a diagram of a second lock portion.

FIG. 12 is a diagram of the structure of the second lock portion 7. The second lock portion 7 includes a first locking portion 71, a second locking portion 72, and a movement restriction portion 73.

The first locking portion 71 in an embodiment is a protrusion having a hook-like shape formed in the holding member 24. The holding member 24 holds the platen 42 to the cover 22. More specifically, the holding member 24 is provided on the cover 22 to hold both ends in the longitudinal direction of the platen 42, and is rotatable about the axis of the platen 42 in a predetermined angular range. The rotation of the holding member 24 about the axis of the platen 42 is not biased.

Figure 13:
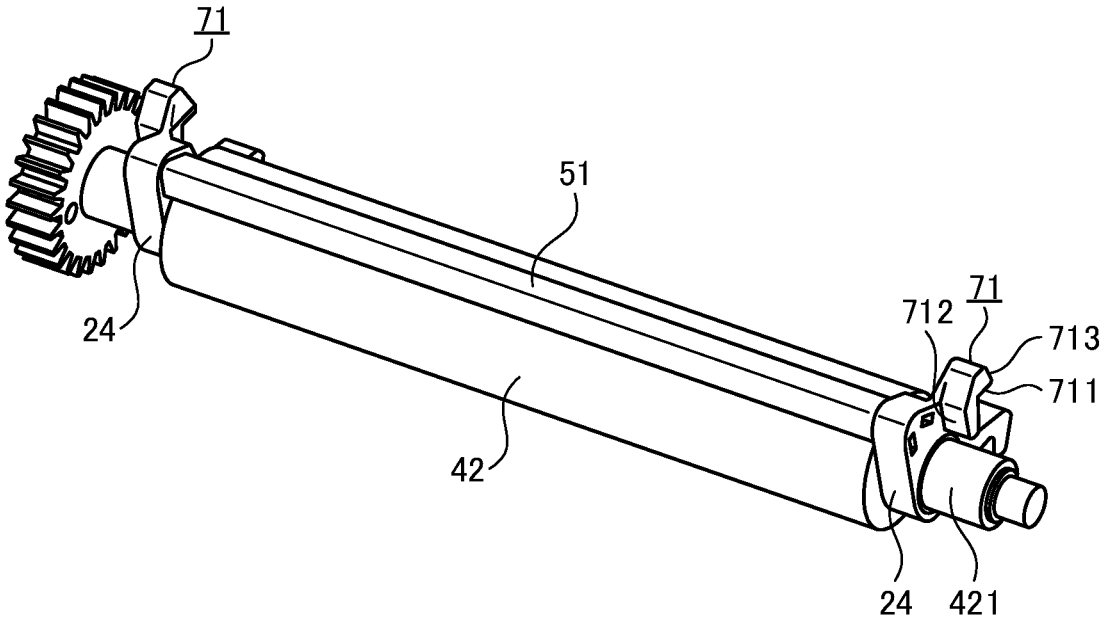
FIG. 13 is a perspective view of a holding member and a first locking portion holding a platen.
Figure 14:
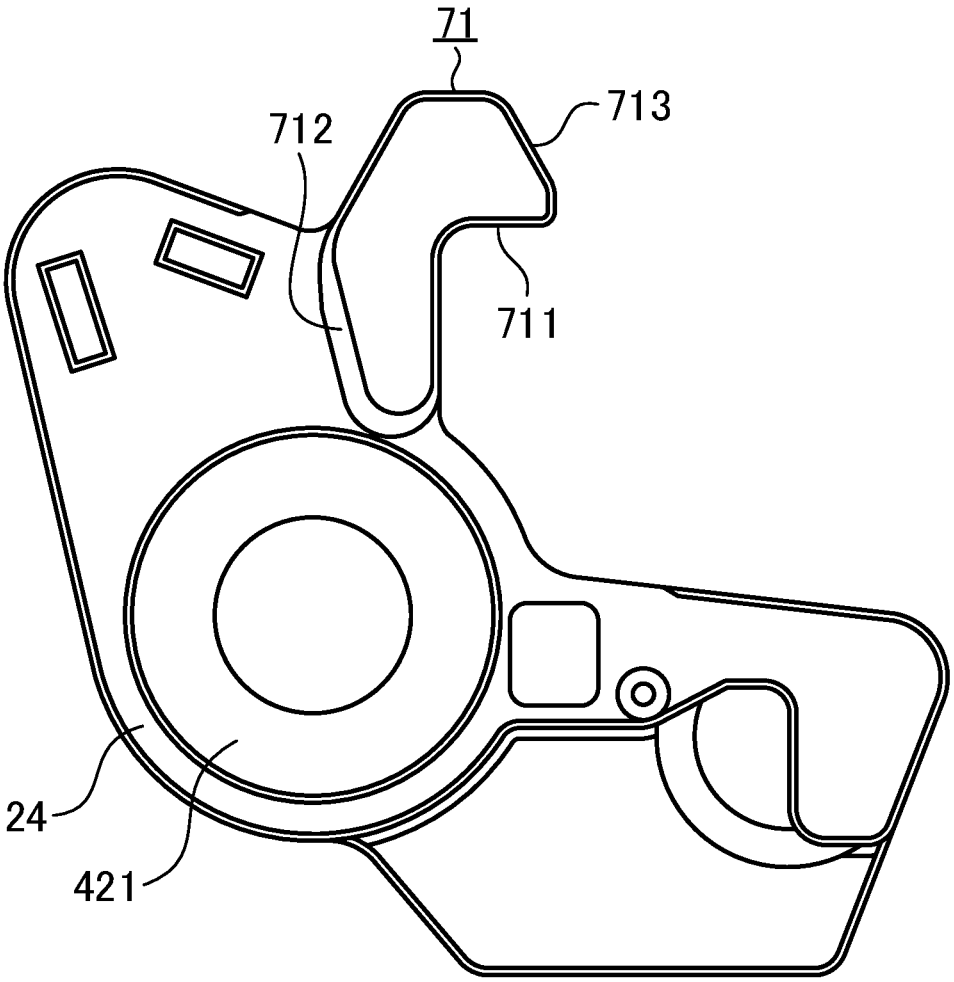
FIG. 14 is a side view of a first locking portion.

FIG. 13 is a perspective view of the holding member 24 and first locking portion 71 which hold the platen 42. FIG. 14 is a side view showing the shape of the first locking portion 71. The first locking portion 71 has a hook-like shape, and includes a hooking portion 711, a restricted portion 712, and a guide portion 713 on the outer peripheral surface thereof. The hooking portion 711 holds the second locking portion 72. The movement of the restricted portion 712 is restricted by the movement restriction portion 73. The guide portion 713 guides the outer peripheral surface of second locking portion 72.

The second locking portion 72 is a projection having a hook-like shape corresponding to first locking portion 71 formed in a side portion of the pressing member 52, and is held by the first locking portion 71 when the pressing member 52 is at the peeling position.

The movement restriction portion 73 is provided in the first lock portion 6 and is part of the outer peripheral surface of the release lever 81 having the first lock portion 6. When the cover 22 covers the sheet storage portion 3, the movement restriction portion 73 comes into contact with the restricted portion 712, which is part of the outer peripheral surface of the first locking portion 71, to restrict the movement of the first locking portion 71 in the rotating direction, thereby retaining the second locking portion 72 by the first locking portion 71. The movement restriction portion 73 is a part of the guide portion 61.

The second lock portion 7 having the structure described above is released from the first lock portion 7 when, in response to the movement of the first lock portion 6 to release the cover 22, the movement restriction portion 73 moves away from the first locking portion 71 and then the cover 22 and the pressing member 52 move in accordance with the biasing force.

Figure 15:
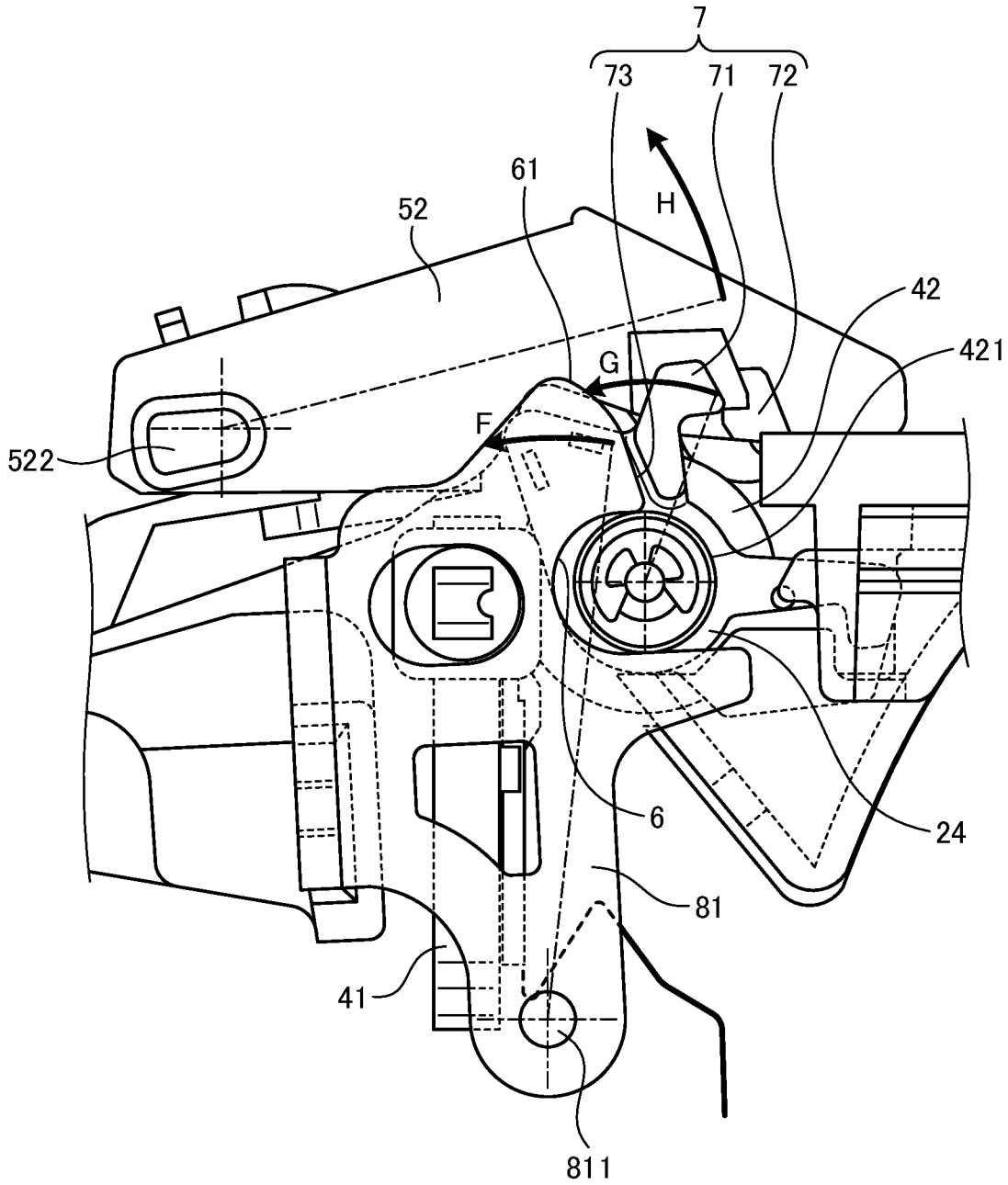
FIG. 15 is a diagram illustrating aspects of the mechanical actions of a first lock portion and a second lock portion.

The operation of the cover 22 and the pressing member 52 in the printer 1 having such a configuration will be described. FIG. 15 is a diagram for explaining mechanical actions of the first lock portion 6 and the second lock portion 7.

When the user presses the release button 82 of the printer 1 in the operating state shown in FIG. 3 and FIG. 6, the release lever 81 rotates in the direction indicated by the arrow F around the pivot hole 811. As the rotation progresses, the holding power of the shaft 421 of the platen 42 by the first lock portion 6 becomes gradually weaker, and the cover 22 moves toward the open position in accordance with the urging force.

Further, due to the rotation of the release lever 81 (arrow F), the movement restriction portion 73 is moved away from the restricted portion 712 of first locking portion 71, and the first locking portion 71 rotates in the direction indicated by arrow G. Then the pressing member 52 pivots in the direction indicated by arrow H about the projection portion 522 in accordance with the urging force. As the rotation progresses, the locking between the first locking portion 71 and second locking portion 72 becomes gradually loose, and immediately after the state shown in FIG. 15, the locking therebetween is released. The pressing member 52 is moved to the retracted position according to the urging force.

Then, the cover 22 is moved to the open position when the depth of the release button 82 pressed by the user becomes deeper and the rotation of the release lever 81 (arrow F) is further advanced, and the first lock portion 6 is fully disengaged from the first lock portion 421.

Since the pivot hole 811, the shaft 421, the first locking portion 71 and the second locking portion 72 are arranged so as to have the positional relationship as shown in FIG. 14, each component is moved as shown in FIG. 15.

Conversely, when the housing 2 is closed, when the user moves the cover 22 toward the closed position against the urging force, the guide portion 61 is pushed by the shaft 421 so that the release lever 81 pivots against the bias (in the direction indicated by the arrow F). When the cover 22 is further moved, the shaft 421 is guided by the guide portion 61 to fit into the first lock portion 6. In such a case, the release lever 81 is rotated in the reverse direction of the arrow F in accordance with the urging force.

Also, when the user moves the pressing member 52 toward the peeling position against the bias (the direction opposite of arrow H), the second locking portion 72 is guided into the guide portion 713 and snaps into the hooking portion 711. During this operation, the first locking portion 71 presses the movement restriction portion 73 to slightly pivot the release lever 81 against the biasing force of the user in the direction of arrow F. This pivoting is such that the second locking portion 72 is moved into the hooking portion 711 through the guide portion 713 of the hook-like first locking portion 71, which is a slight angular rotation such that the retention of the shaft 421 by first lock portion 6 is not released.

In the aforementioned embodiments, the second lock portion 7, which can be unlocked by the user's simple operation of the release button 82, is configured by modifying the existing structure of a conventional printer. Therefore, according to the embodiments, it is possible to reduce the number of components of the printer, which results in cost reduction and simpler manufacturing process, while allowing a user to open a cover via a simple operation.

In the embodiments described above, the holding member 24, the first lock portion 6 and the second lock portion 7 are each paired, but the present disclosure is not limited thereto.

In the above embodiments, the holding member 24 is rotatable about the shaft 421 of the platen 42 over a predetermined angular range, but the present disclosure is not limited thereto, and in general the holding member 24 may be moved in manners other than over the predetermined angular rotation range as long as the holding member 24 can achieve the same function(s) as described in conjunction with the example embodiments.

Furthermore, although the first locking portion 71 and second locking portion 72 have a hook-like shape in the above-described embodiment, they are not limited to this shape and may have a shape other than a hook-like shape as long as they can achieve the same function(s) as described in conjunction with the example embodiments.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed:

1. A printer, comprising:

a body with a sheet storage location that accommodates a label sheet;

a cover that is rotatably attached to the body and covers the sheet storage location when closed, the cover being biased upward to open; and a release button for opening the cover when the cover is closed, wherein the cover includes:

a roller including and rotatable around a shaft and configured to convey the label sheet when the cover is closed, a peeling bar extending above the roller along a longitudinal direction thereof, and a pair of holding members attached to and rotatable around the shaft of the roller and by which the roller is held therebetween, and the body further includes:

a pressing member that extends along the longitudinal direction and is rotatable and biased upward, wherein the pressing member is engageable with the holding members of the cover and configured to, when engaged with the holding members, hold the cover closed and press a part of the label sheet conveyed by the roller against the peeling bar so as to peel a label from the label sheet, and a release lever at an end of the pressing member in the longitudinal direction, the release lever having a recess and configured to rotate between a first position where the shaft of the roller held in the recess and a second position where the shaft is released from the recess, and the release lever rotates from the first position to the second position to disengage the holding members of the cover from the pressing member of the body and open the cover when the release button is pressed.

2. The printer according to claim 1, wherein each of the holding members includes a first locking portion, the pressing member includes a second locking portion at an end thereof in the longitudinal direction, and the second locking portion engages with the first locking portion when the shaft of the roller is held in the recess of the release lever.

3. The printer according to claim 2, wherein when the release lever rotates from the first position to the second position, the shaft of the roller is released from the recess after the first and second locking portions are disengaged.

4. The printer according to claim 3, wherein the holding members are rotatable about the shaft according to rotation of the release lever, and the first locking portion is disengaged from the second locking portion after the release lever has rotated from the first position.

5. The printer according to claim 2, wherein each of the first and second locking portions has a hook-like shape.

6. The printer according to claim 1, wherein the release lever includes a tip portion that moves downwardly as the release button is pressed downwardly.

7. The printer according to claim 6, wherein the release lever is biased to stay at the first position.

8. The printer according to claim 7, wherein the cover is biased to rotate to open and is kept closed when the shaft thereof is held in the recess of the release lever, and the cover rotates to open when the holding members have disengaged from the pressing member and the shaft of the roller is released from the recess of the pressing member.

9. The printer according to claim 7, wherein the pressing member is biased to rotate to open in a rotation direction opposite to a rotation direction of the cover and is kept closed when engaged with the holding members.

10. The printer according to claim 1, wherein the pressing member is movable between a first position where the label is peeled from the label sheet when printed and a second position where the label is not peeled from the label sheet when printed.

11. The printer according to claim 10, wherein the pressing member is rotatable to open at the first position.

12. The printer according to claim 1, wherein the pressing member includes a pair of pressing rollers that contact both ends of the label sheet but do not contact the label.

13. The printer according to claim 1, further comprising:

a printing unit configured to print an image on the label, wherein the printing head is located below the roller when the cover is closed.

14. The printer according to claim 13, further comprising:

a battery configured to supply power to the printing unit.

15. The printer according to claim 14, wherein the battery is located below the releasing lever.

16. The printer according to claim 1, wherein the release button is located on the body and adjacent to the pressing member.

17. The printer according to claim 1, wherein the label that has been peeled from the label paper and the label sheet where the label has been peeled off are separately discharged above the cover.

18. The printer according to claim 1, wherein the label sheet is rolled and stored in the sheet storage unit.

* * * * *